United States Patent [19]

Sakai et al.

[11] 4,456,188

[45] Jun. 26, 1984

[54] APPARATUS FOR SLACKING YARN IN WINDER

[75] Inventors: Shoji Sakai; Michiaki Fujiwara; Nobunori Kubota; Koshi Noda, all of Kyoto, Japan

[73] Assignee: Murata Kikai Kabushiki Kaisha, Kyoto, Japan

[21] Appl. No.: 327,107

[22] Filed: Dec. 3, 1981

[30] Foreign Application Priority Data

Dec. 4, 1980 [JP] Japan ..... 55-174345

[51] Int. Cl.[3] ..... B65H 54/22

[52] U.S. Cl. ..... 242/35.5 R; 57/261; 57/328

[58] Field of Search ..... 242/35.6 R, 35.5 R, 242/18 R; 57/261, 263, 328

[56] References Cited

U.S. PATENT DOCUMENTS

| | | | |
|---|---|---|---|
| 3,281,088 | 10/1966 | Matsui et al. | 242/35.6 R |
| 3,640,059 | 2/1972 | Lutovsky et al. | 242/35.6 R X |
| 4,121,409 | 10/1978 | Uchida et al. | 57/261 X |
| 4,223,517 | 9/1980 | Husges et al. | 57/261 |

*Primary Examiner*—Stanley N. Gilreath

*Attorney, Agent, or Firm*—Spensley, Horn, Jubas & Lubitz

[57] ABSTRACT

A yarn slacking apparatus for slacking and retaining a fed yarn therein during the knotting operation in a winder. The sucking action is caused in the slack tube only when the knotting operation is carried out, while the sucking action of the slack tube is stopped by means of providing a shutter means for an opening of the slack tube, when the knotting operation is not conducted.

13 Claims, 5 Drawing Figures

APPARATUS FOR SLACKING YARN IN WINDER

BACKGROUND OF THE INVENTION

When a yarn spun in a pneumatic spinning apparatus or the like is wound on a package or the like, or when a bobbin is changed and re-winding is carried out, if a yarn being wound is broken, the splicing or knotting operation must be conducted. A slack tube is disposed to suck the yarn ends and eliminate yard slack during the splicing operation. However, since this slack tube continues the sucking action even when the splicing operation is not carried out, an unnecessary load is imposed on a sucking system.

SUMMARY OF THE INVENTION

The present invention relates to an improved slacking device in a winder or the like. More particularly, it relates to an improved slack tube which is provided to a winder for sucking a yarn during the splicing or knotting operation.

An object of the present invention is to provide a yarn slacking device by which the load imposed on the sucking system is reduced to a minimum level.

According to the present invention, the sucking action is caused in the slack tube only when the knotting or splicing operation is carried out, while the sucking action of the slack tube is stopped when the knotting or splicing operation is not conducted.

DETAILED DESCRIPTION OF THE INVENTION

Figure 1:
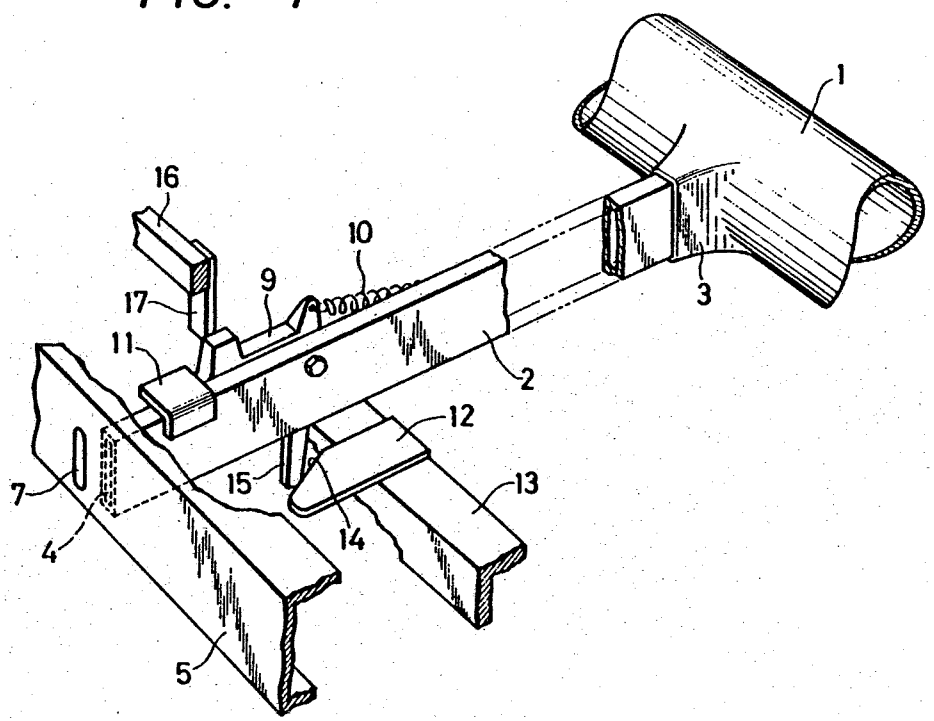
FIG. 1 is a perspective view illustrating one embodiment of the apparatus of the present invention.

One embodiment of the present invention will now be described in detail with reference to the accompanying drawings.

One common main suction tube 1 is laid out on the back portions of units arranged in parallel along the entire width of the machine, and the main suction tube 1 is connected to a suction system (not shown). Slack tubes 2 for the respective units are swingably mounted on the main suction tube 1. More specifically, a slack tube 2 may be loosely fitted in a supporting piece 3 projected from the main suction tube 1, or the supporting piece 3 may be constructed by an elastic member or a bellows member. A suction opening 4 is formed on the end of the slack tube 2, and the suction opening 4 is brought into close contact with a shutter plate 5. In order to bring the suction opening 4 into close contact with the shutter plate 5, the slack tube 2 is always urged to the left in FIGS. 1 through 3 by a spring (not shown). Openings 7 are formed on the shutter plate 5 along running passages of yarns 6 being wound on packages 26 in the respective units so that the distance between every two adjacent openings 7 are the same as the distance between every two adjacent units. A slub catcher 8 is disposed below each opening 7. In the present invention, a first swivelling member is disposed for swinging and moving the slack tube 2 so that the suction opening 4 of the slack tube 2 is communicated with the opening 7 of the shutter plate 5, and a second swivelling member is disposed for swinging and moving the slack tube 2 in the reverse direction. The structures of the first and second swivelling members will now be described.

Figure 2:
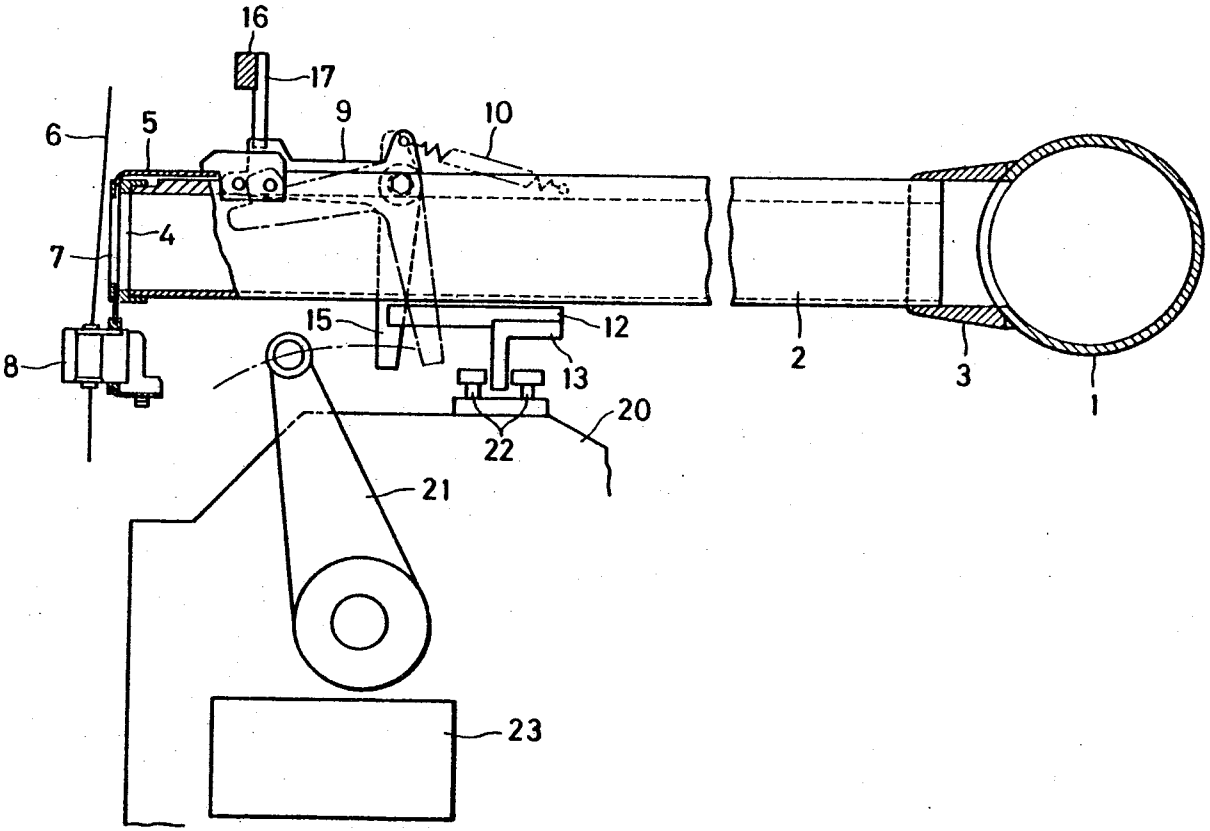
FIG. 2 is a side view of the apparatus shown in FIG. 1.
Figure 3:
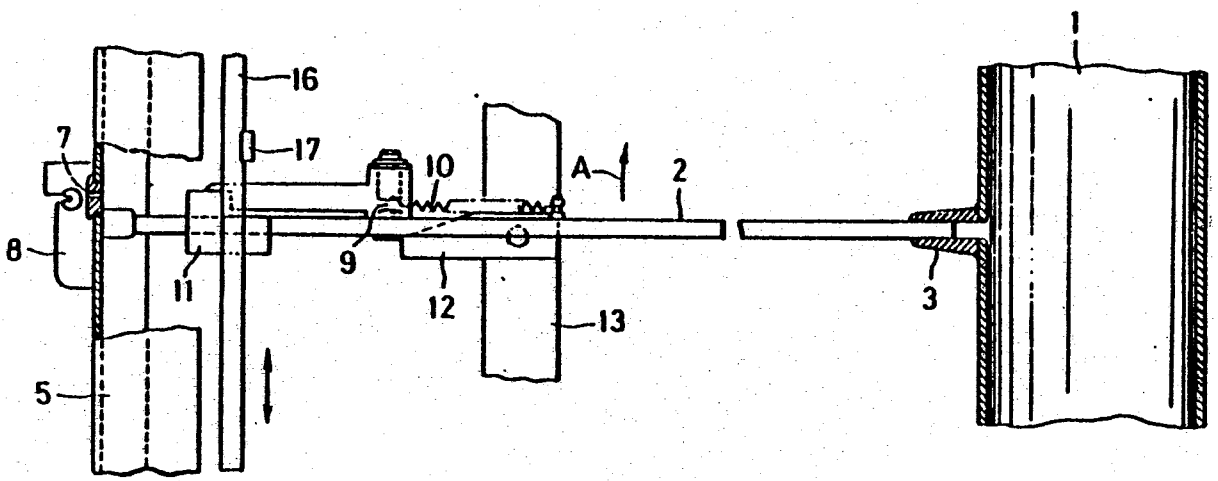
FIG. 3 is a plan view of the apparatus shown in FIGS. 1 and 2.

An L-shaped arm 9 is pivoted on the slack tube 2, and the arm 9 is urged by a spring 10 so that it turns in the clockwise direction in FIGS. 1 and 2. A stopper 11 is disposed on the slack tube 2 to inhibit excessive turning of the L-shaped arm 9. A cam piece 12 is mounted on a frame 13 so that an inclined face 14 of the cam piece 12 is brought into abutting contact with a lower arm portion 15 of the L-shaped arm 9. A bar 16 capable of reciprocating in the longitudinal direction of the machine is disposed above the slack tube 2. A nail piece 17 is mounted on the bar 16. The nail piece 17 falls in abutting contact with the L-shaped arm 9 when the L-shaped arm 9 is brought into abutting contact with the stopper 11. A yarn guide (not shown) is mounted on the bar 16. The yarn guide directs the yarn to the cylindrical feed roller 32 during the winding operation. The bar 16 makes a reciprocating traverse movement during the winding operation and the traverse width is the same as the width of a feed roller 32, and the bar 16 always traverses the yarn so as to prevent wearing of the feed roller which is caused when the yarn is always kept in contact with a specific position of the feed roller.

A knotter truck 20 is disposed to move among a plurality of units arranged in parallel to one another for performing the knotting or splicing operation, and the knotter or splicer truck 20 comprises a yarn joining means 23 and a pair of yarn holding members 28, 30 for holding the yarn ends of a broken yarn and guiding the yarn ends to the yarn joining means 23. Reference numeral 21 represents a swinging arm and when it swings, the end thereof falls in abutting contact with the lower arm portion 15 of the L-shaped arm 9. Reference numeral 22 represents a guide roller.

The operation of the apparatus of the present invention will now be described.

When the slub catcher 8 does not detect a slub or yarn breakage does not occur, the bar 16 makes a reciprocative movement while traversing the yarn. The L-shaped arm 9 is attracted by the spring 10 and kept in abutting contact with the stopper 11. Accordingly, the nail piece 17 is kept in contact with the L-shaped arm 9 and brings the L-shaped arm 9 downward in FIG. 3 with the traverse movement, and the slack tube 2 pivoting the L-shaped arm 9 thereon is kept in the state turned in the counterclockwise direction with the supporting piece 3 being as the fulcrum and the suction opening 4 on the top end of the slack tube 2 is kept in contact with the non-open portion of the shutter plate 5. Therefore, in this state, suction of air from the suction opening 4 is prevented.

When yarn breakage takes place in the above-mentioned state, the knotter or splicer truck 20 stops at a position confronting the unit where yarn breakage takes place, in response to a signal from the slub catcher 8, and the yarn holding members 28, 30 of the truck 20 hold the package side and feed side yarn ends of the broken yarn 6 and guide them to the yarn joining means 23. When the knotter bill of the yarn joining means 23 holds the feed side yarn end, the slack tube 2 is swivelled so that the suction opening 4 of the slack tube 2 is communicated with the opening 7 of the shutter plate 5. More specifically, in response to the signal from the slub catcher 8, the swinging arm 21 turns in the clockwise direction in FIG. 2 and falls in abutting contact with the lower portion 15 of the L-shaped arm 9 to turn the L-shaped arm 9 as indicated by a one-dot chain line. Since the lower portion 15 of the L-shaped arm 9 is brought in contact with the inclined face 14 of the cam 12 at this time, with turning of the lower portion 15 in the counterclockwise direction in FIG. 2, the lower portion 15 moves upward in FIG. 3, with the result that the slack tube 2 which is integrated with the L-shaped arm 9 is swivelled in the direction A in FIG. 3 with the supporting piece 3 being as the center and the suction opening 4 is communicated with the opening 7, whereby the slack tube sucks the yarn end from the opening 7.

After the knotting or splicing operation by the yarn joining means 23 has been completed, by turning of the swinging arm 21 in the counterclockwise direction, the lower portion 15 of the L-shaped arm 9 is set free and the L-shaped arm 9 is returned to the original position indicated by a solid line in FIG. 2 by the elastic force of the spring 10. Accordingly, when the bar 16 making the traverse movement moves downward in FIG. 3, the nail piece 17 falls in abutting contact with the L-shaped arm 9 to press the L-shaped arm 9 downward (in FIG. 3). Therefore, also the slack tube 2 is swivelled to the position indicated in FIG. 3 and the suction opening 4 separates from the opening 7, with the result that the sucking action of the slack tube 2 is stopped.

According to the present invention the opening 4 of the slack tube 2 is communicated with the opening 7 of the shutter plate 5 to suck the yarn on the spinning side into the slack tube at the same time that a knotter bill of the knotter (not shown) holds yarn ends of the package side 26 and spinning side 27 and knots them together. The yarn continuously spun during the knotting operation is sucked and retained in the slack tube 2 thereby preventing an occurrence of kinky threads due to loosening of yarns.

During the operation for guiding the yarns on the package side and feeding side into the knotter 23, the sucking action by the slack tube 2 is not applied to the yarn because the slack tube is shut by the shutter plate 5. So, even if the yarn on the spinning side passes in front of the opening 7 of the shutter plate 5 during the yarn guiding process, the yarn is not sucked into the slack tube, and a miss in the process of guiding the yarn into the knotter can be prevented.

Figure 4:
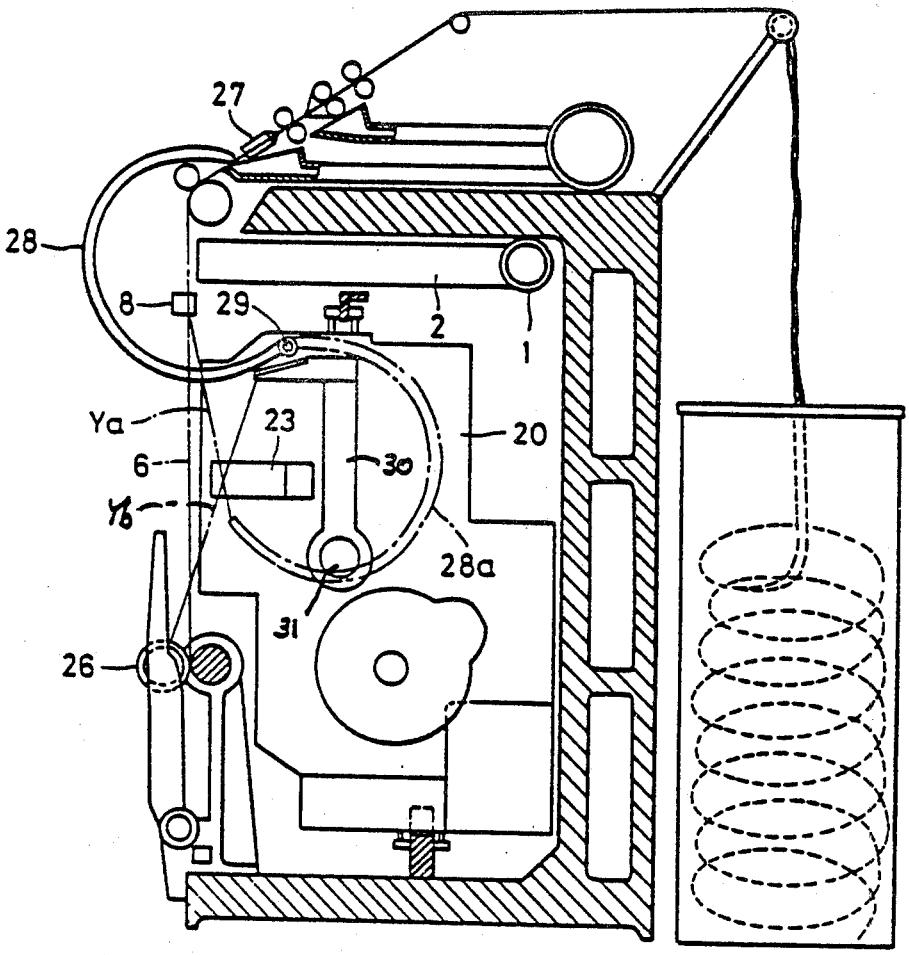
FIG. 4 is a diagramatic side view illustrating one embodiment of a spinning apparatus.

In the embodiment shown in FIG. 4, suction pipe 28 acts as a device for holding the yarn end on the feeding side. The pipe 28, which is able to turn about supporting shaft 29 to the position shown in solid line. The pipe 28, which is able to turn about support shaft 29 to the position shown in solid line, turns in the counterclockwise direction sucking the yarn on the feeding side 27 therein and inserts the yarn Ya into the knotter 23 in conjunction with another guide at the position shown by the two dotted line **28*a*. The yarn end on the package side Yb is sucked into the suction pipe 30, which rotates about shaft 31, and is introduced into the knotter 23. At this time, if the sucking action from the slack tube 2 is effected, the yarn can be held only if the suction force from the suction pipe 28*a* is larger than the suction force from the slack tube. In the present invention, as aforementioned, it is not necessary to increase the suction force of the suction pipe 28 because the sucking action is not effected at the opening 7** during the yarn guiding operation into the knotter.

Figure 5:
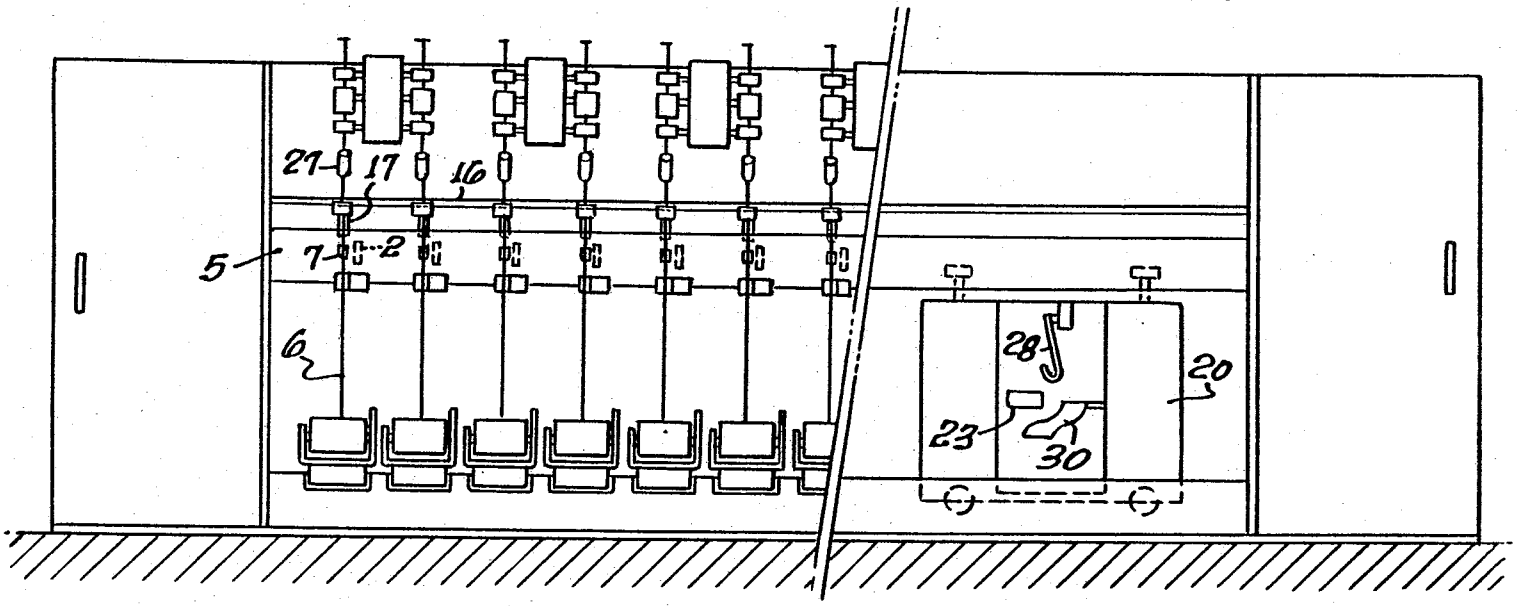
FIG. 5 is a partial front view of a spinning machine in accordance with the present invention, including a representation of a service truck.

As shown in FIG. 5, showing a partial front view of a spinning machine in accordance with the present invention, the relationship between the shutter plate 5 with its elongated openings 7, and the slack tubes 2, the second oascillating member 16, and the nail pieces 17, are clarified based on the description given earlier herein. Additionally, FIG. 5 shows the orientation of the service truck 20, the yarn end holding and guiding members 28 and 30, and the knotter 23.

As will be apparent from the foregoing description, in the apparatus of the present invention, since the sucking action of the slack tube is exerted only during the splicing action and the sucking action is stopped while the yarn is travelling during the winding operation, the load imposed on a blower of the suction system can be reduced to a minimum level. Therefore, the size of the blower can be minimized and consumption of electric power can be reduced.

What is claimed is:

1. An apparatus for providing slack to a yarn during a joining of yarn ends to form the yarn to be wound in a spinning machine, which machine includes a plurality of machine units, each performing a winding operation, said machine units being disposed parallel to each other, said spinning machine being provided with a service truck adapted to travel along the plurality of machine units and containing a yarn joining means as well as two holding and guiding members for holding the yarn ends and for guiding the two yarn ends into the yarn joining means, comprising:

a shutter plate, mounted along said machine units of said spinning machine, having a plurality, in like number as the number of machine units, of elongated openings formed therein, one of said openings being in proximity to a corresponding machine unit and disposed to extend along said shutter plate in a direction parallel and adjacent to the running path of the yarn to be wound in that machine unit;

a plurality of slack tubes, one provided in each machine unit for slacking and retaining excess yarn of its machine unit therein, each slack tube having a suction opening at one end thereof, each said suction opening being in close contact with a back surface of said shutter plate, each said slack tube being adapted to swivel between a first position and a second position;

a suction means for providing suction, communicated with the end of each slack tube opposite that in close contact with said shutter plate;

a first movable member, adapted to swivel at least one of said slack tubes into its first position in response to an externally provided signal calling for slacking of the yarn on that machine unit wherein said slack tube is swivelled, in which first position said suction opening of the swivelled slack tube is aligned with the corresponding opening of said shutter plate; and a second movable member adapted to return each slack tube from its first position into its second position upon termination of said externally provided signal, in which second position the suction opening of the returned slack tube is separated from its corresponding opening in said shutter plate and the sucking action of said slack tube is stopped.

2. An apparatus as claimed in claim 1, wherein said first movable member is provided on the service truck and is actuable when the holding and guiding members have guided the yarn ends into the yarn joining means.

3. An apparatus as claimed in claim 1, wherein each said slack tube is loosely fitted, at its end opposite that in contact with said shutter plate, into a corresponding supporting piece projected from the suction means.

4. An apparatus as claimed in claim 1, wherein each said slack tube is fitted into a corresponding elastic supporting piece projected from the suction means.

5. An apparatus as claimed in claim 1, wherein each of the slack tubes is provided with an L-shaped arm pivoted on said slack tube, a spring expanded between said slack tube and an upper arm of the L-shaped arm, and a stopper disposed on said slack tube to inhibit excessive rotation of the L-shaped arm by action of the spring.

6. An apparatus as claimed in claim 5, wherein, for each of said slack tubes, a cam piece having an inclined face is mounted on a frame so that the inclined face is brought into abutting contact with a lower arm of the L-shaped arm.

7. An apparatus as claimed in claim 6, wherein said first movable member is a rotatable arm, having a free end which rotates into abutting contact with the lower arm of the L-shaped arm of the machine unit in which slacking of the yarn is to be performed to turn said L-shaped arm to bring its lower arm into contact with the inclined face of its corresponding cam piece so that the corresponding slack tube is swivelled into its first position where its suction opening is communicated with the corresponding opening of the shutter plate.

8. An apparatus as claimed in claim 7, wherein said second movable member includes a bar capable of reciprocating in the longitudinal direction along the spinning machine and disposed above the slack tubes, said bar having a plurality of nail pieces which are mounted on the bar and each of which makes abutting contact with the corresponding L-shaped arm when the L-shaped arm is brought into abutting contact with the corresponding stopper to move the corresponding slack tube to its second position and to keep the corresponding suction opening in contact with the shutter plate so that the sucking action of the corresponding slack tube is stopped.

9. An apparatus for slacking yarn during the joining of a first and a second yarn end in a spinning unit of a spinning machine having a plurality of said spinning units disposed in parallel to each other, comprising:

a shutter plate having a plurality of plate openings formed therein, one for each spinning unit, each said plate opening extending along the running path of said yarn within the corresponding spinning unit;

a like plurality of slack tubes, one for each spinning unit, each having a suction opening at one end thereof, each said suction opening being movably in contact with said shutter plate;

a suction means for providing suction, communicating with the other end of each said slack tube;

a first movable means for selectively moving each said slack tube into a first position in which its suction opening is coincident with its corresponding plate opening; and a second movable means for selectively moving each said slack tube into a second position in which its suction opening is not coincident with its corresponding plate opening, whereby the sucking action of that slack tube is stopped.

10. An apparatus as in claim 9, in which said spinning machine further comprises:

a service truck adapted to travel along said spinning units and being locatably disposed at one of said spinning units requiring service, wherein said service truck comprises:

a yarn joining means for joining together said first and said second yarn ends;

a first holding and guiding member for holding said first yarn end and for guiding said first yarn end into said yarn joining means; and a second holding and guiding member for holding said second yarn end and for guiding said second yarn end into said yarn joining means.

11. An apparatus as in claim 10 wherein said first movable means is provided on said service truck.

12. An apparatus as in claim 10 wherein said first movable means is activated when said first and second yarn ends of the spinning unit at which said service truck is disposed are guided to said yarn joining means by said first and second holding and guiding members.

13. An apparatus as in claim 9 further comprising a plurality of supporting pieces, each flexibly connecting said suction means and a corresponding one of said slack tubes.

* * * * *